United States Patent [19]

Zahn et al.

[11] Patent Number: 5,061,938

[45] Date of Patent: Oct. 29, 1991

[54] MICROSTRIP ANTENNA

[75] Inventors: Rudolf Zahn, Markdorf; Hans W. Schroeder; Christian Borgwardt, both of Immenstaad; Albert Braig, Markdorf; Gunter Helwig, Daisendorf; Joachim Boukamp, Markdorf; Oswald Bender; Chung-chi Lin, both of Friedrichshafen; Werner Scherber, Bermatingen, all of Fed. Rep. of Germany

[73] Assignee: Dornier System GmbH, Friedrichshafen

[21] Appl. No.: 271,036

[22] Filed: Nov. 14, 1988

[30] Foreign Application Priority Data

Nov. 13, 1987 [DE] Fed. Rep. of Germany ..... 3738513

[51] Int. Cl.[5] ..... H01Q 1/38

[52] U.S. Cl. ..... 343/700 MS; 343/846

[58] Field of Search ..... 343/700 MS, 829, 846, 343/789

[56] References Cited

U.S. PATENT DOCUMENTS

| | | | |
|---|---|---|---|
| 4,131,894 | 12/1978 | Schiavone | 343/700 MS |
| 4,521,781 | 6/1985 | Campi et al. | 343/700 MS |

FOREIGN PATENT DOCUMENTS

| | | | |
|---|---|---|---|
| 207703 | 11/1984 | Japan | 343/700 MS |
| 97409 | 5/1987 | Japan . | |
| 118609 | 5/1987 | Japan | 343/700 MS |
| 254806 | 10/1988 | Japan . | |
| 2046530 | 11/1980 | United Kingdom | 343/700 MS |

*Primary Examiner*—Michael C. Wimer

*Attorney, Agent, or Firm*—Ralf H. Siegemund

[57] ABSTRACT

A microstrip antenna has an electrically conductive base plate carrying an electrically insulating substrate on top of which are a plurality of radiating patches, the improvement comprises establishing a relatively large spacing between the electrically insulating substrate and the base plate at lateral dimensions larger than lateral dimensions of the patches and in the vicinity of the patches and either through local elevations of the insulating substrate or by local indents in the base plate being vertically aligned with the patches.

30 Claims, 2 Drawing Sheets

Fig. 1
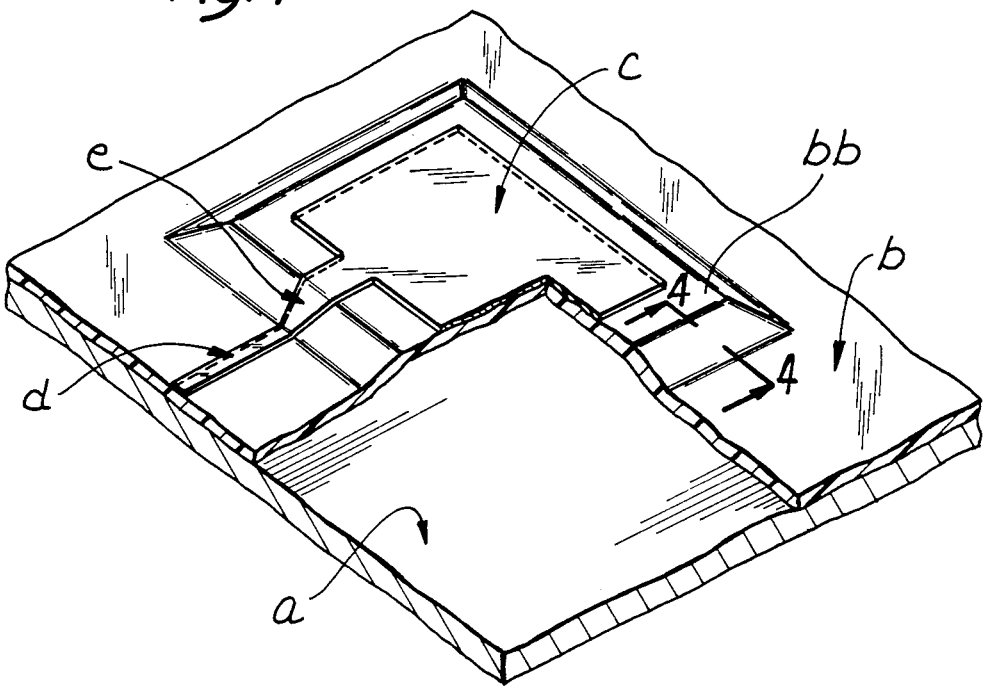
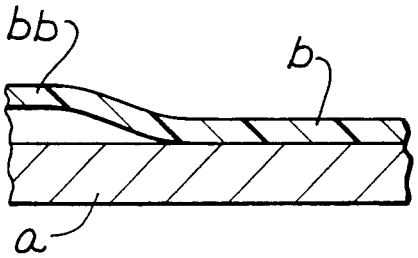
Fig. 4

Fig. 2
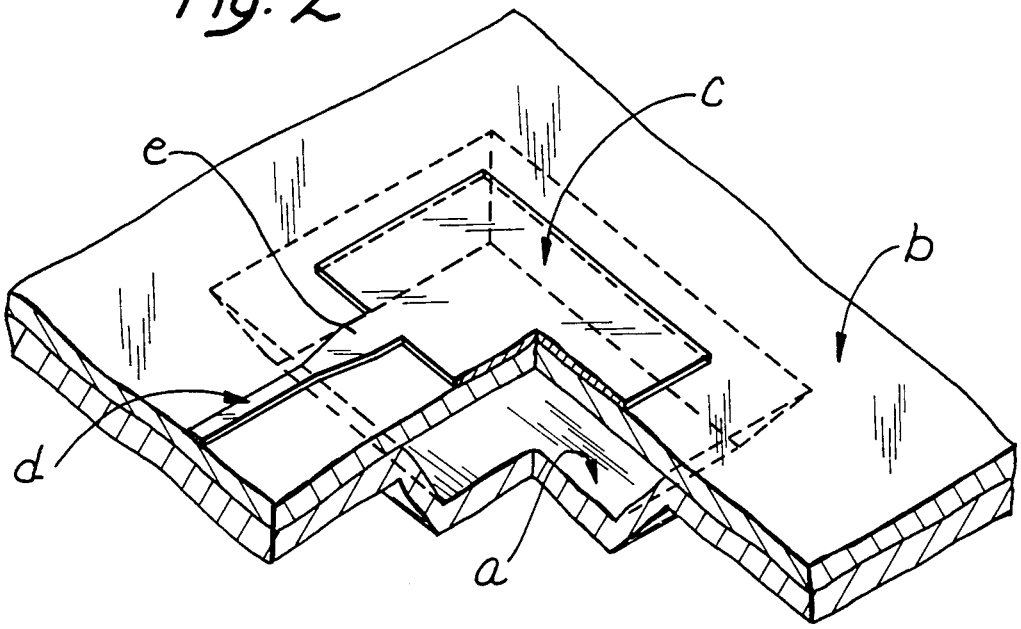
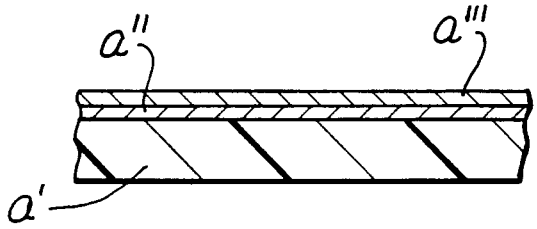
Fig. 3

MICROSTRIP ANTENNA

BACKGROUND OF THE INVENTION

The present invention relates to a microstrip antenna particularly of the type used in aircraft and space vehicle applications.

Microstrip antennas have a number of favorable properties which makes them attractive to the aerospace industries. These include flat and therefore thin constructions, economical as well as accurate manufacture including faithful reproduction of the radiating geometry, particularly under utilization of lithographic methods. Moreover, group array or antennas can be realized in conjunction with a feeder network under utilization of the same substrate. For these reasons this particular type and kind of antenna is quite attractive for employment in active group array or antennas.

On the other hand it has to be considered that the conventional antenna construction features small distance between radiating element and the conductive base plate which is detrimental for the efficiency of radiation; also detrimental are the permissible dimensions and material tolerances as far as properties and physical constants are concerned. Increasing the relevant distances by choosing a thicker substrate material is disadvantaged by a commensurate increase in weight. Also the portion of power conducted through surface waves will also be larger with increasing thickness of the substrate material which on the other hand reduces efficiency and deteriorates the radiation pattern.

Some of the drawbacks could be offset by choosing a substrate with a lower density of material or one could use a multilayer or multiply material which in overall dimensions is thicker but has air or vacuum strata in between. Still alternatively, one could use foam or honeycomb support structures. In all these cases the weight is actually reduced and also the surface wave conduction is reduced but on the other hand it was found that there was an increase in undesirable parasitic radiation from the feeder lines. Feeding electrical power now becomes a problem owing to larger distances between the radiating elements and the base plate in the antenna structure. Here parasitic radiation obtains which of course is undesirable.

The maintaining of an accurate distance between the plane of radiation and the base plate in an antenna structure moreover requires, particularly in the case of a compound substrate under utilization of air or vacuum, a particular support structure. In the case of active antennas for space vehicles moreover it is necessary that these materials have a good thermal conductivity in order to provide for heat removal from the transmitter and for receiver modules arranged on the base plate and adjacent the antenna's front side. In the case of substrates which are thin in material such a thermal conductivity is simply not present particularly in those cases where there is a vacuum area included in the substrate.

German printed patent application 28 16 362 proposes a microstrip antenna which is comprised of a multiplicity of small cavity resonators for the purpose of providing certain resonance effects. The cavities are formed in that the radiators have a specified distance from the base plate. However, the problem area mentioned above namely efficiency vs weight vs heat conduction is not dealt with at all in that particular application.

DESCRIPTION OF THE INVENTION

It is an object of the present invention to provide a new and improved microstrip conductor antenna for aircraft and space vehicle applications which combines a high degree of efficiency with low weight, mechanical stiffness, low stray and parasitic radiation i.e. very little strip conductor losses will be incurred while on the other hand there is good thermal conductivity transversely to the plane of the antenna.

It is a specific object of the present invention to provide a new and improved microstrip antenna which includes an electrically conductive base plate, an electrically insulating substrate on top of it and a plurality of radiating elements (patches) on top of the insulating substrate.

In accordance with the preferred embodiment of the present invention the objects are attained in that locally the spacing between the antenna patches and the conductive base plate is increased in that either the insulating substrate is provided with elevations whereever carrying an antenna patch; additionally or alternatively the base plate is provided with trough or tublike depressions or indents under these antenna patches. These depressions and the aforementioned elevations are preferably characterized by larger lateral dimensions than the corresponding dimensions of the carried or associated radiating patches.

The invention increases the efficiency and the bandwidth as well as tolerance in sensitivity of such microstrip antennas. The feeder system will not or only insignificantly radiate owing to their higher capacitive coupling with the base plate. Surface waves are not stimulated or at least any stimulation is not enhanced. The weight of the antenna remains low, and adequate thermal conductivity to the radiating plane is provided for heat transfer since the antenna as a whole can be constructed very thinly with the exception of the portions under the radiating elements.

The basic concept behind the invention is to provide in some fashion locally a larger distance between the radiating patches and the base plate which as far as substrate thickness is concerned, is effective only in the zone or area underneath the respective radiating element and patch. This increase in spacing is basically obtained through a deformation of the base plate or an elevation of the insulating substrate, or a combination of both. The resulting space between substrate and base plate may either be a vacuum or air be filled or filled with dielectric material such as foam or with a honeycomb kind of material to enhance mechanical stiffness.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a perspective view of a portion of a strip antenna in accordance with the preferred embodiment of the present invention for practicing the best mode therein;

FIG. 2 is another example of the preferred embodiment of the present invention also showing a strip antenna portion in perspective view;

FIG. 3 illustrates a modified layer configuration for the base to be used in either example; and FIG. 4 illustrates a section along line IV—IV of FIG. 1.

Proceeding to the detailed description of the drawings in each instance there is provided a base plate a which is a metallic conductor to be described as far as material is concerned more fully below. On top of the base plate or substrate a is provided an electrically insulating substrate b which in turn carries radiating elements, patches c. These radiating elements c are connected to feeder lines or strips d which are relatively thin, and reference numeral e refers to a widened transition portion by means of which a conductor d is connected to the radiating element c.

FIG. 1 shows that the particular radiating patch c is carried by an elevation bb of and in the substrate b. As shown in FIG. 4, the space between the elevated portion bb of substrate b and the base plate a is filled with air or dielectric foam. FIG. 2 shows the bottom side of the element a which is provided with an indent or tub shaped depression aa. Hence there is also a certain large space between the substrate b and the base a. The substrate b in this case is flat and carries, as can be seen from FIG. 2, in flat support the radiating patch c. The geometries are such that the elevations bb and the depressions or indents aa are wider and larger than the respective patches c.

As far as the invention is concerned it is thus realized in the two versions illustrated or by a combination of both. It can readily be seen that in each case opposing demands for high efficiency and wide bandwidth of the radiating elements on one hand, realized through a large distance between radiator patch c and base plate a with small dielectric number effective in between, is advantageously combined with the opposing demand of low strip losses i.e. freedom from parasitic radiation and ease of coupling the feeder lines for power supply to the particular radiating element c. Thus feeding without parasitic radiation requires a small substrate thickness i.e. a small thickness of the layer b, for a medium to high dielectric number. These opposing constraints are in both instances combined in a single configuration. On the other hand the weight remains low and the heat conduction from the base plate a generally to the radiating surface plane is present indeed. The particular space configurations that are needed are the result of the elevations and/or depressions which provide for the requisite features without adding to the weight and in fact enhance mechanical stability.

Matching the wave resistance is preferably provided in those instances where the distance between the surface conduction and the base plate varies. This variation in distance is realized in both instances at the positive to negative elevations or the negative to positive changes and thus involves the transitions e and their dimensions.

The matching and feeding, in particular the feeding network, is provided on top of the substrate which has the advantage that the radiating elements c provided so to speak as end parts of the feeder network can, in terms of printed circuit technology, be established in one and the same basic process. Owing to the fact that no transitions are needed the accuracy and reproducibility is very large and in effect these parameters are the same as far as the radiating elements c on one hand and the feeder lines d and e on the other hand are concerned.

It may be of advantage in addition to provide a thermal coating in order to enhance heat radiation or if necessary to reduce the receiving of solar radiation.

Concerning the materials involved and here particularly the base plate a there are no basic limitations. Decisive is that the surface of plate a is a good electrical conductor and, preferably, made either of metal or of a metallized, carbon fiber reinforced synthetic. The latter is usable since it has a low thermal coefficient of expansion. The base plate a' (FIG. 3) may thus be made actually of synthetic material such as fluorocarbonhydrogen, particularly a material of the kind known by the name TEFLON. This kind of a synthetic substrate is then covered with highly electrically conductive and mechanically very resistive and good adhering layer made of Cr, Cu, Ti, Pd, or Au.

Owing to its good adhesion and high conductivity as well as owing to the fact that galvanic thickness enhancement is very easy, copper is particularly desirable for this layer a'' to be put on top of the base plate proper. For enhancing corrosion resistance the copper may in turn be coated with gold a'''. Thus the base plate (a) in both examples may be preferably made of a Teflon base a' covered with a copper layer a'' which in turn is covered with gold layer a'''.

The Teflon is first mechanically and chemically cleaned whereupon the Teflon is sputter etched in a vacuum following which a copper layer of about 300 nm thickness is sputtered on top of the Teflon. Thereafter the copper is galvanically increased in thickness to whatever value is deemed desirable which may be variable under the circumstances. Finally a protective thin layer a''' of gold is vapor deposited on top of the copper a''. Modern cassette sputter devices permit layering and coating of large areas of substrates, that means areas in excess of 1 $m^2$. Such a device is used in case of depositing by sputtering layers on top of automobile windows, other windows to obtain certain optically effective layer.

The substrate b may be comprised of multiple dielectric layers of reinforced or unreinforced synthetic materials particularly thermoplastic materials. These kinds of materials exhibit sufficiently low dielectric losses. Examples here are all those kinds of materials used for high quality radomes as well as for conductor plates in microwave engineering.

From the point of view of electrical engineering it is apparent that reinforced as well as unreinforced materials on the basis of fluorocarbonhydrogen compounds such as PTFE, FEP or PFA or materials on the basis of polyethylene are well suited for employment as insulating substrate b. A particularly suitable material is fiber reinforced polyethylene. This kind of material is suitable for taking advantage of its very low thermal coefficient of expansion. Polyethylene can not only function as a dielectric layer but is also suitable for a carrying function.

In a particular example it was realized that the substrate b was made of a 1 mm thick plate of fiber reinforced polyethylene with a base structure of carbon fiber reinforced epoxy resin.

In order to manufacture the indentations (aa) or elevations (bb) the particular plate is thermomechanically deformed. In a particular example a 1.5 mm plate made of glass microfiber reinforced PTFE traded under the designation RT/DUROID5780 was deep drawn at 350 degrees C. through placement in between two suitable contoured metal plungers. In another example the substrate b or a was worked mechanically through milling or the like.

The coating of the substrate b can be carried out by a method which was already mentioned above with regard to coating of the base plate a. The structuring of the metal layers may be carried out through etch methods or through lift-off procedure. The etch resist material or lift-off material may be applied through photosensitive lacquers or in a foil, or one may use mechanically structured polymer and/or metal foil.

The following methods are suitable for specific applications. A light sensitive foil is rolled onto a Teflon substrate of the microstrip antenna. Then a metal coating is applied as described above or is vapor deposited or sputtered onto the substrate. Following the last mentioned coating the foil is withdrawn together with all undesired areas, which is a kind of negative imaging method. The optically structured foils may be applied prior to or after deforming of the Teflon substrate. Alternatively one may use a dip lacquering using a photolacquer whereby the dip lacquer for purposes of lift-off of the free areas is removed through acetone.

The coupling of the element c, finally, may also be applied as conductors, or substrate b or the substrate b under the respective radiating element c and the suitable dielectric constant between the feeder line and the radiating area is then locally enhanced.

The invention is not limited to the embodiments described above but all changes and modifications thereof, not constituting departures from the spirit and scope of the invention, are intended to be included.

We claim:

1. A microstrip antenna having an electrically conductive base plate carrying an electrically insulating substrate, there being at least one radiating patch element disposed on the insulating substrate, the improvement comprising, said insulating substrate being provided with a local elevation underneath portions of the substrate carrying said at least one radiating patch element, said elevation establishing a relatively large spacing between the electrically insulating substrate, under the respective patch element, and the base plate in the vicinity of the patch and at lateral dimensions larger than lateral dimensions of the respective patch; and a feeder line on said substrate, there being a relatively widened transition portion connecting the respective feeder line in integral configuration to the respective patch element, said widened portion running on a transition of an elevated portion of the elevation to a lower level of the insulating substrate.

2. Antenna as in claim 1 including a space between the substrate and the base plate, being filled with a substance selected from a group consisting of air, vacuum, a dielectric material whose dielectric constant differs from the substrate dielectric constant, a foam material or a honeycomb material.

3. Antenna as in claim 1 wherein the substrate is provided with a thermal coating to establish particular radiating conditions as between that coating and the environment in terms of absorption and emission.

4. Antenna as in claim 1 wherein said base plate being provided as a fiber reinforced synthetic material coated with metal.

5. Antenna as in claim 4 said base plate being comprised of a carbon fiber reinforced synthetic.

6. Antenna as in claim 4 said base plate being comprised of a carbon fiber reinforced epoxy resin.

7. Antenna as in claim 4 said base plate being comprised of a carbon fiber reinforced thermoplastic.

8. Antenna as in claim 4 said base plate being comprised of a fluorocarbonhydrogen.

9. Antenna as in claim 1 wherein the substrate is a multilayer dielectric material.

10. Antenna as in claim 1 the substrate being made of reinforced synthetic material.

11. Antenna as in claim 1 the substrate being made of glass microfiber reinforced thermoplastic material.

12. Antenna as in claim 1 the substrate being made of a fluorocarbonhydrogen.

13. Antenna as in claim 1 the substrate being made of polyethylene.

14. Antenna as in claim 1 the substrate being made of fiber reinforced polyethylene.

15. Antenna as in claim 1 the substrate being made of unreinforced synthetic material.

16. A microstrip antenna having an electrically conductive base plate carrying an electrically insulating substrate there being at least one radiating patch element disposed on the insulating substrate, the improvement comprising said base plate being provided with a local indent vertically aligned with said radiating patch element to thereby provide an increase in spacing between the insulating substrate and the base plate to be effective in the area of said indent, said spacing between the electrically insulating substrate and the base plate having lateral dimensions larger than lateral dimensions of the patch element, there being a feeder line on the substrate, the respective indent not extending under the feeder line; and a transition portion connecting the feeder line in integral configuration to the patch element, and in a transition path of the insulating substrate laterally outside of the indent, the transition portion widening from the feeder line toward the patch element.

17. Antenna as in claim 16 the substrate being made of fiber reinforced polyethylene.

18. Antenna as in claim 16 including a space between the substrate and the base plate, said space being filled with a material selected from a group consisting of air, vacuum, a dielectric material whose dielectric constant differs from the substrate dielectric constant, a foam material or a honeycomb material.

19. Antenna as in claim 16, wherein the substrate is provided with a thermal coating to establish particular radiating conditions as between that coating and the environment in terms of absorption and emission.

20. Antenna as in claim 16, wherein said base plate being provided as a fiber reinforced synthetic material coated with metal.

21. Antenna as in claim 20 said base plate being comprised of a carbon fiber reinforced synthetic.

22. Antenna as in claim 20 said base plate being comprised of a carbon fiber reinforced epoxy resin.

23. Antenna as in claim 20 said base plate being comprised of a carbon fiber reinforced thermoplastic.

24. Antenna as in claim 20 said base plate being comprised of a fluorocarbonhydrogen.

25. Antenna as in claim 16 wherein the substrate is a multilayer dielectric material.

26. Antenna as in claim 16 the substrate being made of reinforced synthetic material.

27. Antenna as in claim 16 the substrate being made of glass microfiber reinforced thermoplastic material.

28. Antenna as in claim 16 the substrate being made of a fluorocarbonhydrogen.

29. Antenna as in claim 16 the substrate being made of polyethylene.

30. Antenna as in claim 16 the substrate being made of unreinforced synthetic material.

* * * * *